US005630384A

United States Patent [19]

Mottier et al.

[11] Patent Number: 5,630,384

[45] Date of Patent: May 20, 1997

[54] MAGNETO-BASED IGNITION SYSTEM FOR RECIPROCATING INTERNAL COMBUSTION ENGINE HAVING A CAPACITIVE DISCHARGE BOOSTER FOR AIDING ENGINE STARTING

[75] Inventors: Bradley D. Mottier; J. Norman MacLeod, both of Jacksonville, Fla.

[73] Assignee: Unison Industries Limited Partnership, Jacksonville, Fla.

[21] Appl. No.: 587,515

[22] Filed: Jan. 17, 1996

[51] Int. Cl.[6] ..... F02P 1/00

[52] U.S. Cl. ..... 123/149 C; 123/620

[58] Field of Search ..... 123/149 C, 620, 123/599, 606, 596, 146.5 A, 153, 146.5 R, 143 R; 315/211, 209 R

[56] References Cited

U.S. PATENT DOCUMENTS

| | | | |
|---|---|---|---|
| 3,788,293 | 1/1974 | Anderson | 123/620 |
| 3,871,348 | 3/1975 | Cavil | 123/149 C |
| 3,874,354 | 4/1975 | Crouch | 123/149 C |
| 4,269,160 | 5/1981 | Irvin, Jr. | 123/620 |
| 4,329,950 | 5/1982 | Orova et al. | 123/149 C |
| 4,365,186 | 12/1982 | Gerry | 315/209 R |
| 4,366,801 | 1/1983 | Endo et al. | 123/620 |
| 4,393,850 | 7/1983 | Nishida et al. | 123/620 |
| 4,398,526 | 8/1983 | Hamai et al. | 123/606 |
| 4,620,521 | 11/1986 | Henderson | 123/149 C |
| 4,774,914 | 10/1988 | Ward | 123/620 |
| 5,179,928 | 1/1993 | Cour et al. | 123/620 |
| 5,215,066 | 6/1993 | Narshige et al. | 123/620 |

FOREIGN PATENT DOCUMENTS 7525867 5/1976 France .

OTHER PUBLICATIONS

Bendix Corporation, "The ABC's of the Bendix Shower of Sparks Ignition System" (1971).

Teledyne Industries, "Starting Vibrator Assemblies," pp. v–ix, p. 9 (1989).

*Primary Examiner*—Raymond A. Nelli

*Attorney, Agent, or Firm*—Leydig, Voit & Mayer, Ltd.

[57] ABSTRACT

A capacitative discharge device is provided as part of a magneto-based ignition system for enhancing the starting performance of the ignition system for an internal combustion engine. The ignition system incorporating the invention is applicable to conventional mechanically timed magnetos, including those intended to incorporate impulse coupling or inductive vibrators as starting aids. Although the ignition system incorporating the invention is primarily intended for aerospace applications, its relative small size the light weight make it also ideal for any type of portable application.

18 Claims, 6 Drawing Sheets

MAGNETO-BASED IGNITION SYSTEM FOR RECIPROCATING INTERNAL COMBUSTION ENGINE HAVING A CAPACITIVE DISCHARGE BOOSTER FOR AIDING ENGINE STARTING

TECHNICAL FIELD

The invention relates to ignition systems for internal combustion engines and, more particularly, to those parts of ignition systems for igniting fuel while starting reciprocating internal combustion engines.

BACKGROUND OF THE INVENTION

Magneto-based ignition systems are well known and are often used with internal combustion engines in applications where batteries are not practical. Magnetos are robust devices that are typically highly reliable. Because of these qualities, magneto-based ignition systems have been historically used with internal combustion engines in aircraft applications. Magneto-based ignition systems are also used in applications employing small internal combustion engines with reciprocating pistons—e.g., lawn mowers, small power tools and the like.

Historically, a single mechanical breaker in the magneto rides an engine-driven cam and controls the timing for discharging energy from the magneto to a mechanical distributor, which distributes the energy to the spark plugs. More recently, electronic ignitions have replaced the mechanical breaker and distributor. In these electronic ignition systems, the spark timing can be dynamically adjusted in order to provide best performance and, specifically, to provide the best timing for starting the engine. However, for magnetos having a mechanical breaker, the advance of the spark timing is mechanically fixed and is typically set to provide full power from the magneto to the spark plugs when the engine is running. When the engine is started, the cranking speeds of the crankshaft of the engine are between 50 and 125 revolutions per minute (RPM). These speeds are much less then the normal operating speeds of the engine and, therefore, the mechanical advance of the spark timing is much more than needed or desired and is even a hindrance to easy starting of the engine.

For many small engine applications, the low energy and poor setting of the timing advance in the magneto during cranking of the engine is merely tolerated. For example, before electronic ignitions became Commonplace in lawn mowers powered by internal combustion engines, their magneto-based ignition systems were difficult to start in large part because of the low power and poor timing described above.

For large internal combustion engines or for applications where it is cost justified, a magneto-based ignition system having mechanical timing have in the past often included a sophisticated mechanical system to retard the spark and provide the necessary electrical energy to fire the spark plugs of the engine when it is started. The two most common types of these mechanical systems are retard breakers which use induction vibrators and impulse couplings.

In an induction vibrator, current from a battery flows through the vibrator coil and contacts and then to the primary coil of the magneto, completing its return circuit through a ground return. The vibrator is a type of buzzer that chops the battery voltage into about 200 sparking pulses per second, which are delivered to the plugs as a continuous stream or "shower" of sparks.

To get a retarded or late spark for starting using an inductor vibrator, the magneto has two breakers in it. One breaker defines the timing of a periodic discharge of energy from the primary coil of the magneto to one of the spark plugs during normal engine operation. The second breaker retards the normal timing for delivering energy from the coil to one of the spark plugs and is employed during engine starting in order to enhance the ability of the magneto to reliably start the engine. The breaker used during engine starting is often called the retard breaker.

When the engine starts, an ignition switch is released from a momentary position, which returns the switch to a position in which the magneto operates on the normal breaker and delivers sparks to each of the plugs timed for normal running operation of the engine. When the starter switch is released from its momentary position, the second or retard breaker is disconnected, which also disconnects the vibrator from the magneto.

In an impulse coupled magneto, a sophisticated mechanical arrangement retards the normal timing of the spark and boosts the energy output of the magneto without employing a second "retard breaker" or requiring a battery powered induction vibrator. An impulse coupling magneto relies solely on the rapid spring assisted rotation of the magnet rotor shaft to generate spark energy. In an impulse coupling, the magneto is snapped through its firing position at a fast angular velocity in order to couple the necessary energy from the magnet of the rotor to the coil of the magneto that delivers energy to the spark plugs. This snapping of the rotor is necessary in order to multiply the slow cranking speed of the engine. As soon as the engine starts, a mechanism responsive to the centrifugal force of the rotating crankshaft of the engine disengages the impulse coupling. In a magneto employing an impulse coupling mechanism, a single spark is delivered to each piston for each stroke cycle.

In French Patent No. 2,287,595, an induction vibrator is described that employs a capacitive discharge circuit for concentrating energy from a battery source and delivering the concentrated energy to the magneto having a "retard breaker." Because of the low frequency operation of the capacitive discharge circuit, the transformer used to pump energy into the storage capacitor and thereby concentrate energy from the battery is relatively large, heavy and inefficient—e.g., a volume of 125 cubic centimeters and a mass of 0.35 kilograms. Because of its considerable size and weight, an induction vibrator of the type disclosed in this French patent is impractical for applications in which size or weight is an important design consideration. For example, in an aircraft application, both size and weight are important design considerations that make impractical the use of the induction vibrator of the French patent. In portable power tools, such as small electrical generators, lawn mowers, pumps, etc. the relatively large size and weight of such an induction vibrator would also be considered impractical.

Although both a vibrator and an impulse coupling are reliable under conditions favorable for ignition, the energy they deliver to the plug is marginal in adverse conditions such as severe weather or poor operating conditions. For example, if an engine is re-started before it has cooled, the coil in the magneto is probably hot and, therefore, has a relatively high resistance. In such situations, starting of the engine may be difficult using only an induction vibrator or an impulse coupling. Also, as part of its normal use, the contact points of a magneto can go out of adjustment or the rotating magnets can lose some magnetism. These phenomena reduce the ability of the mechanized booster for the magneto to consistently deliver sparks of sufficient energy to reliably start the piston engine. Moreover, extreme weather conditions may cause even a magneto with a mechanical booster to not easily start the engine. It is also not uncommon for the spark plugs to be fouled by moisture, lead or fuel, particularly after the engine has sat idle and exposed to the ambient weather conditions for extended periods. In these situations, even a healthy magneto can have difficulty starting the engine.

SUMMARY OF THE INVENTION

It is a general aim of the invention to enhance the starting performance of a mechanically timed, magneto-based ignition system for an internal combustion engine in both normal and severe conditions without the added weight and space of prior art devices. In this connection, it is a more specific aim of the invention to enhance the starting performance of a mechanically timed, magneto-based ignition system for an internal combustion engine in a weight and size sensitive environment when the engine is hot, the plugs are partially fouled or the battery is weak.

It is yet another object of the invention to achieve the foregoing objects using conventional mechanically timed, magneto-based ignition systems. It is a related object of the invention to easily retrofit the invention onto conventional, mechanically timed, magneto-based ignition systems, using either impulse couplings or inductive vibrators.

It is also an object of the invention to provide a starting system for an internal combustion engine that achieves the foregoing objectives and, when used in an aircraft application, interfaces with a pilot of the aircraft in the same manner as conventional ignition systems and in accordance with existing regulatory requirements.

It is a further object of the invention to provide a portable ignition booster for a magneto-based ignition system that is temporarily coupled to the engine for starting it.

It is a more detailed object of the invention to provide a small, light weight accessory for a mechanically timed magneto that boosts the total energy of pulses delivered to the plugs by the magneto during the starting of an internal combustion engine.

Briefly, the invention boosts the energy of ignition pulses from a mechanically timed magneto by concentrating energy from an energy source using a small, high frequency transformer and discharging the energy into the magneto as discrete energy pulses. The energy is concentrated by pumping small, incremental amounts of energy from the energy source into a storage capacitor at a pumping frequency of several thousand increments per second (e.g. 40 KHz). This high pumping frequency coupled with a relatively low frequency of discharging the capacitor (e.g., 60 discharges per second) allows for the use of the small transformer, which in turn allows the invention to maintain a small size and weight amenable for applications such as aircraft and portable equipment.

In a preferred embodiment, the invention is added as an accessory to a conventional impulse coupled mechanically timed magneto. An example of such an impulse coupled magneto is a model 4301, manufactured by the Slick Aircraft Products Division of Unison Industries, Inc. of Rockford, Ill. 61104. As described hereinafter in connection with the illustrated embodiments, however, the invention may also replace induction vibrators or they may enhance the starting of mechanically timed magnetos that are without any type of retard timing related mechanisms.

The invention employs a capacitive discharge circuit that discharges stored energy from a capacitor into a primary coil of the magneto. A converter pumps energy into the capacitor until the value of the voltage at the capacitor reaches a predetermined value. An output circuit then discharges the capacitor into the primary coil. The timing of the discharge from the capacitor is independent and asynchronous with respect to the timing of a breaker switch in the magneto, which controls the timing of the discharge of the energy from the primary coil to the plugs. A controller within the capacitive discharge circuit disables the pumping of the converter into the capacitor while it is discharging into the primary coil. By temporarily disabling the pumping of energy into the capacitor, a switch in the output circuit that initiated the discharging of the capacitor is reliably turned off before the next charging cycle begins. By interrupting the pumping of energy into the capacitor, a solid state switch can be used in the output circuit for controlling the discharging of the capacitor. In this regard, an output circuit of the type disclosed in U.S. Pat. No. 5,065,073, which is assigned to the same assignee as that of the present invention, is preferably used in the capacitive discharge circuit of this invention.

Unlike conventional induction vibrators that simply chop the energy from a battery into discrete pulses, the capacitive discharge circuit of the invention concentrates energy and then delivers it to the magneto in discrete pulses, which results in much higher than conventional values of voltage and energy at the plug. Moreover, these higher voltages are relatively immune from fluctuations in battery voltage, so they are consistently high under most battery conditions. These much higher values result in a spark at the plug that more reliably ignites the fuel mixture in the piston chamber during startup. Moreover, multiple sparks are generated at the plug per piston stroke, which further enhances the energy delivered to each plug with respect to that provided by conventional starting systems. During starting, approximately five sparks are delivered through the distributor for each stroke cycle of the piston.

The invention takes advantage of the relatively low spark rate that is characteristic of the low RPMs of the engine during cranking by employing a high frequency oscillator (e.g., 40 KHz) to pump small incremental amounts of energy into the storage capacitor over a relatively long time period. Because only a small incremental amount of energy is pumped into the capacitor in each pump cycle (e.g., 0.3 millijoules), the transformer used to transfer the energy and boost voltage can be small. For example, the transformer may be a 9053520 by Unison Industries Limited Partnership. The capacitor is charged to approximately 115 millijoules at 350 volts. By pumping at a frequency of 40 KHz and 0.3 millijoules per pump cycle, the capacitor is fully charged in approximately 9.5 milliseconds.

The capacitive discharge circuit is preferably self-triggering so that the capacitor is discharged as soon as it reaches a fully charged state. Therefore, the spark rate is dependent upon the rate of charge at the capacitor, which in turn is dependent on the pumping frequency and the value of energy pumped in each cycle. By maximizing the pumping frequency, the invention provides a high energy booster for starting that is light weight and compact.

While the ignition system of the invention may be part of the original equipment found on a new engine, it is also intended to be easily retrofitted on installed internal combustion engines or it may be incorporated into a portable device that is temporarily coupled to the engine for starting it and disconnected thereafter.

While the invention will be described in some detail with reference a preferred embodiment, it will be understood that it is not intended to limit the invention to such detail. On the contrary, it is intended to cover all alternatives, modifications, and equivalents that fall within the spirit and scope of the invention as defined by the appended claims.

DETAILED DESCRIPTION OF THE ILLUSTRATED EMBODIMENT

Figure 1:
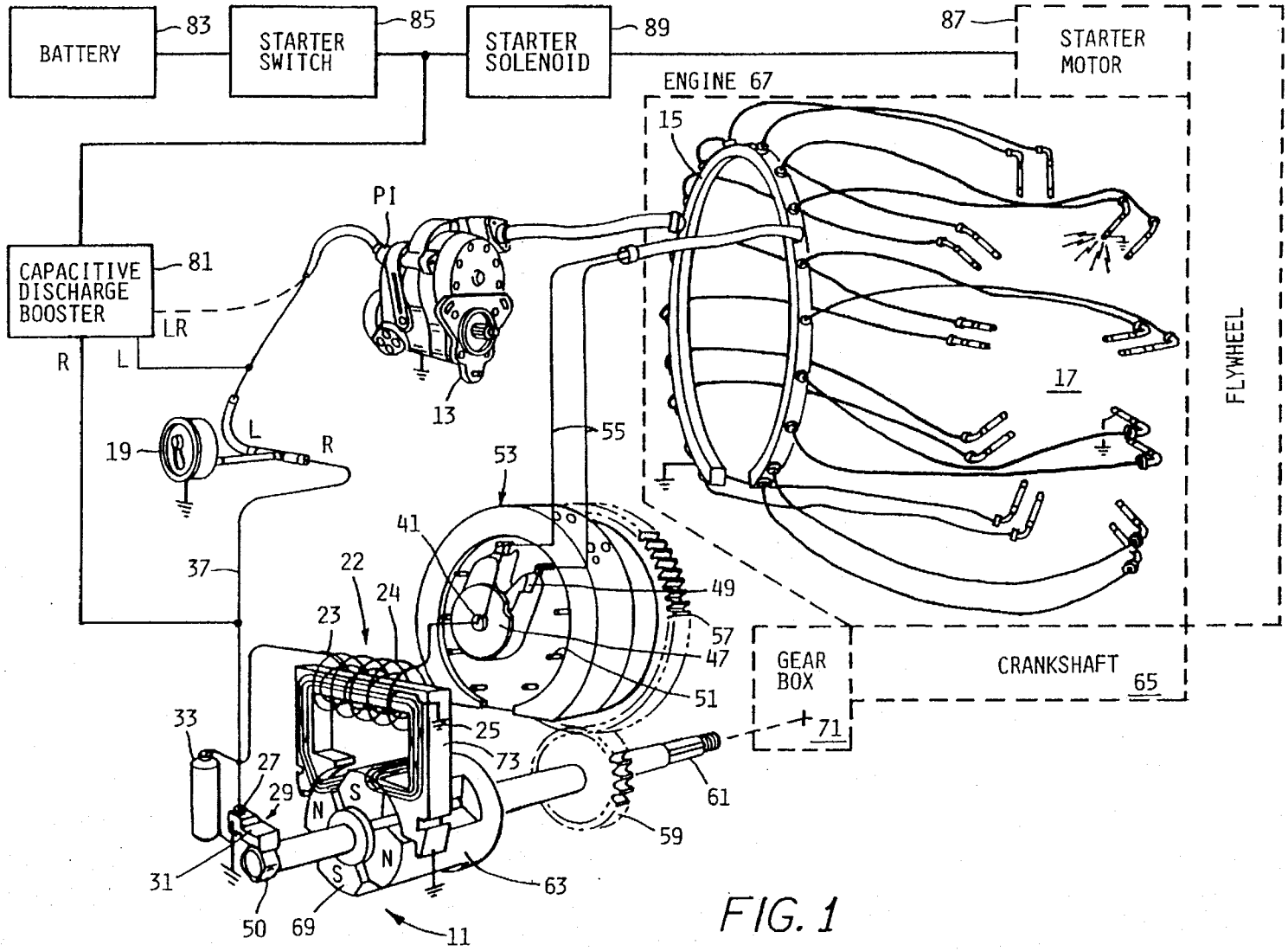
FIG. 1 is a pictorial illustration of a two magneto ignition system according to the invention, showing a capacitive discharge booster for aiding starting the engine according to the invention.

FIG. 1 illustrates a complete high-tension ignition system including of two magnetos 11 and 13, radio shield harness 15, spark plugs 17, an ignition switch 19, and a capacitive discharge booster 81 in accordance with the invention. When a starter switch 85 is closed, energy from a battery 83 is applied to the capacitive discharge booster 81 and a solenoid 89. In a conventional manner, the solenoid 89 transfers the energy from the battery 83 to a starter motor 87, which cranks an engine 67. At the same time energy from the battery 83 is applied to the capacitive discharge booster 81 and concentrated into pulses that are delivered to the magneto 13 at a rate and energy level described hereinafter. As is conventional, when the engine 67 starts, the starter switch 85 is released, which disconnects the battery 83 from the solenoid 89 and the capacitive discharge booster 81. Thus, the capacitive discharge booster 81 functions as part of the ignition system only while the engine 67 is being cranked.

Dual magneto systems such as that illustrated in FIG. 1 are conventional in ignition systems for aerospace applications, which is the intended application of the illustrated system. As discussed hereinafter, however, the invention is also applicable to other applications of internal combustion engines.

Magneto 11 in FIG. 1 is conventional in its construction and will be described in detail hereinafter. To aid in this description, the magneto 11 is illustrated in FIG. 1 in a skeletal form. Magneto 13 is also conventional in its construction, but it differs from the magneto 11 in that it incorporates a mechanism for aiding the starting of the engines 67 as described more fully in connection with FIGS. 2 and 3.

Figure 2A:
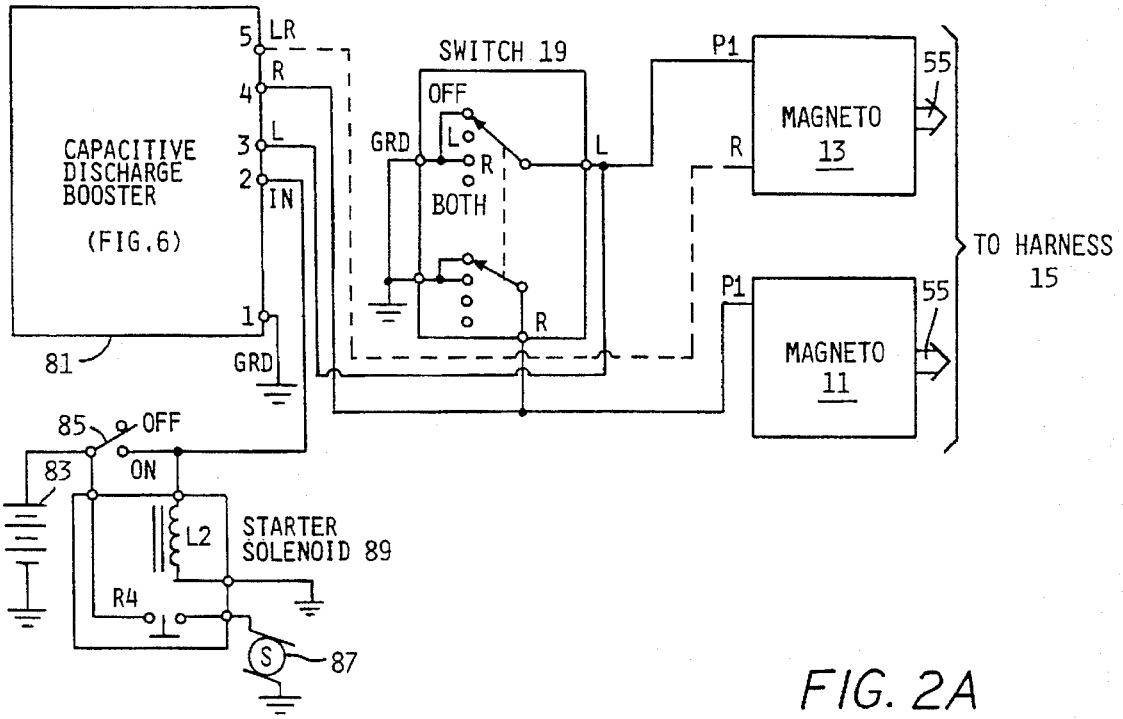
FIG. 2A is a schematic wiring diagram of the ignition system of FIG. 1.
Figure 2B:
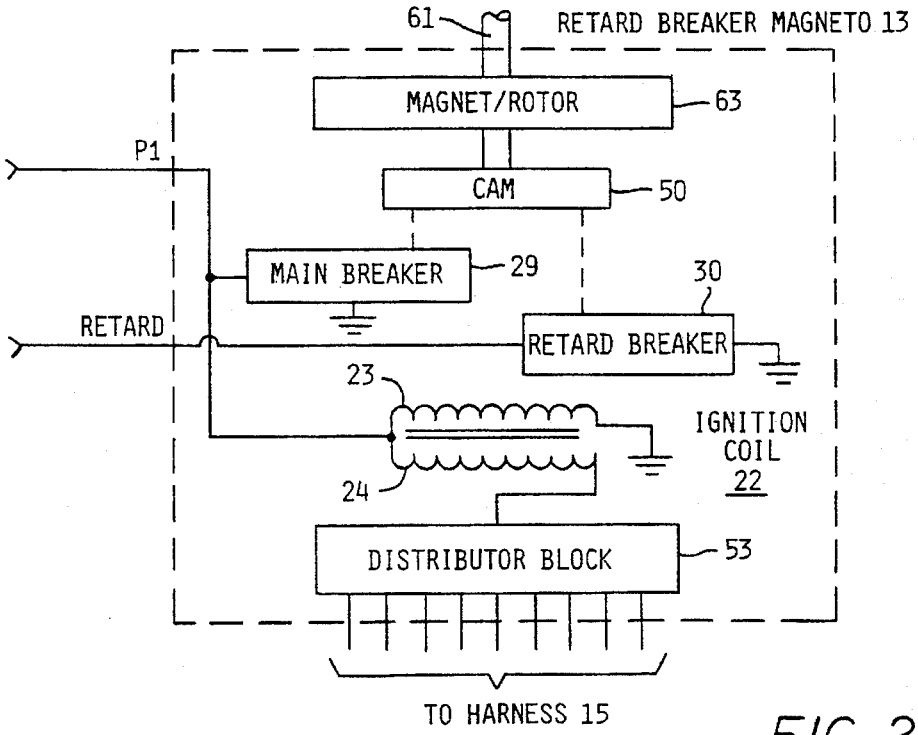
FIG. 2B is a schematic block diagram of a retard breaker magneto in keeping with a first embodiment of the schematic wiring diagram of FIG. 2A.
Figure 2C:
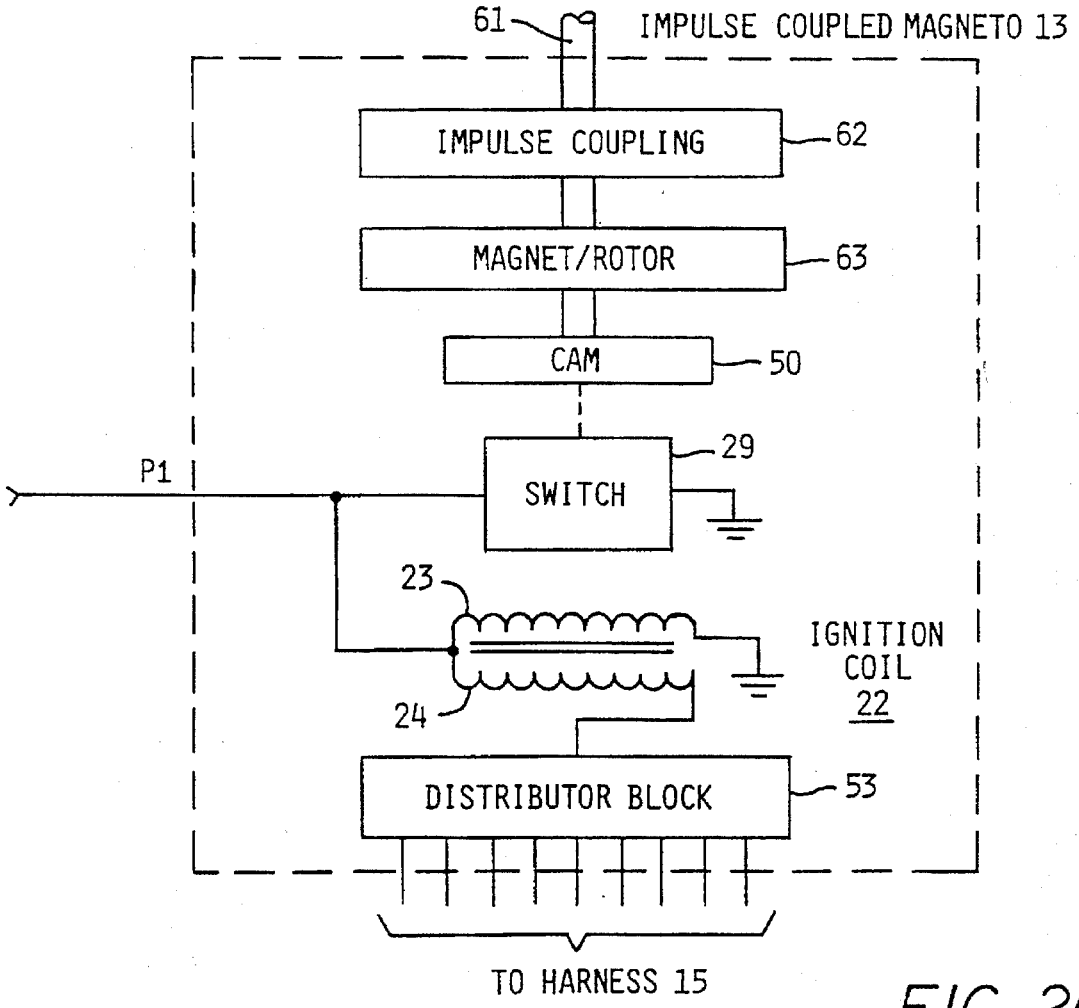
FIG. 2C is a schematic block diagram of the impulse coupled magneto in keeping with a second embodiment of the schematic wiring diagram of FIG. 2A.

In one embodiment illustrated in FIGS. 2A and 2B, the magneto 13 is a conventional retard breaker magneto as described above in the BACKGROUND section. In this type of magneto, a main breaker functions during normal operation of the magneto and a "retard breaker" functions during starting of the engine in order to retard the timing of the spark events as an aid to starting the engine. An alternative configuration for the magneto 13 illustrated in FIGS. 2A and 2C is that of a conventional impulse coupling magneto also described above in the BACKGROUND section. This type of magneto employs an "impulse coupling" that enhances the energy transfer from the rotating magnet rotor of the magneto to the primary winding of the ignition system coil while simultaneously mechanically retarding the ignition spark timing.

The following is a description of the operation of a conventional magneto with reference to the skeletal form of magneto 11 in FIG. 1. Those familiar with magnetos will appreciate that the conventional structure shown by the skeleton form of the magneto 11 in FIG. 1 is common to both a conventional "retard breaker" and "impulse coupling" magnetos and, therefore, the general operating characteristics of the magnetos 11 and 13 in the ignition system of the invention will be described in detail only with respect to the skeleton form illustrated for the conventional magneto 11.

In the illustrated ignition system of FIG. 1, an engine 67 has nine (9) cylinders and the rotating magnet rotor 63 has four (4) poles. A gearbox 71 provides a power take-off drive interfacing the drive shaft 61 of the rotating magnet rotor 63 and the crankshaft 65 of the engine 67. Since the number of sparks that can be produced by the rotating magnet rotor 63 in one revolution is equal to the number of poles on the rotor, the greater the number of poles on the rotor, the more sparks the rotor can produce at a certain speed of rotation. Thus, an 8-pole magneto, if used on a 14-cylinder engine is driven at ⅞ engine crankshaft speed, whereas it would be necessary to drive a 4-pole magneto at $2\times\frac{7}{8}=1\frac{3}{4}$times engine crankshaft speed. In the illustrated ignition system, the 4-pole magnet 63 is driven at ⅝ engine speed.

While the engine 67 is running, the sole source of energy for the ignition system is the rotating magnet 63 of the magneto 11 and a similar rotating magnets of the magneto 13. The timing of magnetos 11 and 13 are mechanically fixed. The ignition timing point is usually set to occur at the peak of the magneto's output voltage curve.

When an engine is started, the fixed advance of the spark timing and the low energy level of the pulses delivered to the spark plugs often make it difficult to start the engine. The low energy of the spark pulses is caused by the low RPMs of the magnet 63 during cranking, which results in a slowly changing magnetic field at the primary coil 23 that couples only a relatively small amount of energy into the coil. Sparks are not produced at the plugs 17 until the rotating magnet 63 is turned at or above a critical number of revolutions per minute (e.g., 100 RPM) at which speed the rate of change in flux linkages is sufficiently high to induce the required primary current and the resultant high-tension output. This speed varies for different types of magnetos but the typical is 100 RPM. This is known as the "coming-in" speed of the magneto. Conditions may make it impossible to rotate the crankshaft 65 of the engine 67 fast enough to produce the "coming-in" speed of the magneto.

To overcome this poor timing and low energy during starting of the engine 67, magneto-based ignition systems often employ apparatus for boosting the energy of the pulses delivered to the plugs during cranking of the engine and retarding their timing. Both of these adjustments are necessitated by the relatively low RPMs (e.g., 50 RPMs) of the crankshaft 65 during cranking of the engine compared to the much higher RPMs of the crankshaft when the engine 67 is operating (e.g., 500 to 4,000 RPMs).

The apparatus may be either in the form of an impulse coupling 62 (FIG. 2C), which temporarily increases the rotational speed of the magnet 13 using mechanical means, or an induction vibrator (not shown), which delivers energy directly from a battery to a primary coil 23 of the retard-breaker magneto 13 (FIG. 2B). Both impulse couplings and induction vibrators boost the energy provided to the plugs 17 and retard the timing under starting conditions.

In an induction vibrator, a pulsating voltage is supplied to the primary coil 23 of the magneto. This pulsating voltage is stepped up by the transformer action of a secondary coil 24 of the magneto to provide the required voltage for firing the spark plugs 17. The sparks are provided to the plugs 17 at a high frequency and synchronously with respect to the positions of the engine pistons 18. This ignition mode for starting the engine is sometimes referred to as a "shower of sparks" mode.

Unlike an induction vibrator, an impulse coupled magneto does not require an external battery in order to boost the energy level of the pulses delivered to the plugs 17 during starting of the engine 67. The impulse coupling 62 of the magneto 13 in FIG. 2C mechanically retards the advance timing of the ignition system without requiring the presence of the second "retard" breaker 30 in the vibrator-assisted magneto 13 of FIG. 2B.

In accordance with the invention, the capacitive discharge booster 81 can be retrofitted to a conventional piston ignition system employing the magneto 13 either as an impulse coupled magneto or a retard breaker magneto as generally illustrated in FIGS. 1 and 2A–2C. The high energy pulses from the capacitive discharge booster 81 are delivered to the retard breaker or impulse coupled magneto 13 at its P1 terminal, thereby enhancing the starting ability of the ignition system without requiring any modification of the magneto. In a conventional manner, the switch 19 controls the operation of the magnetos 11 and 13.

In keeping with the ability of the invention to be retrofitted to conventional magneto-based ignition switches, the switch 19 is a four-position dual switch that is conventionally used in the ignition system for aircraft applications. Specifically, the switch 19 is used by a pilot to test the dual magnetos 11 and 13 prior to flight. The four-position dual switch 19 includes a first position for maintaining the magnetos 11 and 13 in an off condition, a second position L for operating the "left" magneto 13, a third position R for operating the "right" magneto 11, and a fourth position for operating both magnetos, which is the normal operating position. Those familiar with these types of switches will appreciate that they vary in design. Some are as illustrated, others have five positions or may distribute the switching function to more than one switch. As the term is used herein, "switching assembly" means ganged or separate switches for controlling the magnetos 11 and 13.

Referring to 1 and 2A, the capacitive discharge booster 81 has five input/output lines that are selectively connected to the piston ignition system, the precise connections depending on whether the magneto 13 is a retard breaker magneto or an impulse coupled magneto. In either case, an output L of the capacitive discharge booster 81 is directly connected to the P1 terminal of the magneto 13. Likewise, the output R is directly connected to the terminal P1 of the magneto 11. As indicated by the dashed line in FIGS. 1 and 2A, an output LR from the capacitive discharge booster 81 is also connected to the magneto 13, depending on whether the magneto is a retard breaker or impulse coupling type. Specifically, if the magneto 13 is a retard breaker type, the LR output from the capacitive discharge 81 is directly connected to a retard breaker 30 in the magneto 13, as indicated by the separate R input to the magneto 13 in FIG. 2A.

The ignition switch 19 in FIGS. 1 and 2A is electrically connected to the insulated contact point 27 in each of the magnetos 11 and 13 by way of a wire 37 and the terminal P1. When the switch 19 is in the "off" position, the P1 terminal and the contact point 27 are directly connected to ground in each of the magnetos 11 and 13. Therefore, when the opposing contact points 27 and 31 of the breaker 29 are open and the switch 19 is in the "off" position, any current in the primary coil is not interrupted, thus preventing the production of high voltage in the secondary coil 24 of each magneto and unwanted ignition sparks.

When the ganged switch 19 is in the "L" position of FIG. 2A, the P1 terminal of the magneto 13 is disconnected from ground and high voltage pulses from the L output of the capacitive discharge booster 81 appear at the terminal P1 and are delivered to the primary coil 23 of the magneto 13. However, the second of the two wiper contacts maintains a ground connection in the "L" position and, therefore, the P1 terminal of the magneto 11 remains grounded.

In its "R" position, the switch assembly 19 grounds the P1 terminal of the magneto 13 and cooperates with a relay switch in the capacitive discharge booster 81 (see FIG. 5) to disconnect from ground the P1 terminal of the magneto 11, assuming the engine 67 is running. If the pilot attempts to start the engine with the switch assembly 19 in the "R" position, the P1 terminals of both magnetos 11 and 13 will be grounded and no ignition will be initiated. Finally, in the "BOTH" position of the switch assembly 19, the P1 terminals of both magnetos 11 and 13 are disconnected from ground and enabled when the engine is running.

FIGS. 2B and 2C illustrate in a block diagram fashion the two alternative configurations for the magneto 13 in FIGS. 1 and 2A. Referring first to FIG. 2B, the magneto 13 may be configured to include a retard breaker 30, which cooperates with the cam 50 (see FIG. 1) in a well-known manner to retard the timing of the energy transfer from the primary coil 23 to the secondary coil 24 of the ignition coil 22. As explained more fully hereinafter, the capacitive discharge booster 81 provides high energy pulses to both the P1 terminal and the retard input of the retard breaker magneto 13 when the starter switch 85 is closed. When both the main breaker 29 and the retard breaker 30 are open, the high energy pulses from the capacitive discharge booster 81 are coupled to the secondary coil 24 and delivered to the spark plugs 17 by way of a distributor block 53.

In the alternative configuration of the magneto 13 illustrated in FIG. 2C, an impulse coupling 62 is positioned between the shaft 61 and the magnet 63 in order to translate the slow rotation of the shaft 61 during starting to a momentary or impulse rotation of the magnet 63 that provides a fast changing magnetic field that then couples significant energy into the primary coil 23, which is then transferred to the secondary coil 24 of the ignition coil 22 under control of the main breaker 29 in a well known manner. Because the impulse coupling 62 provides both the retard timing and an energy boost for starting, it is commonly employed in ignition systems that depend on the magneto to provide sufficient energy for starting. In contrast, a retard breaker magneto utilizes energy from a battery source in order to store energy in the primary coil 23, which is then coupled to the secondary coil 24 and distributed to the plugs 17 in accordance with conventional magnets action.

Figure 3A:
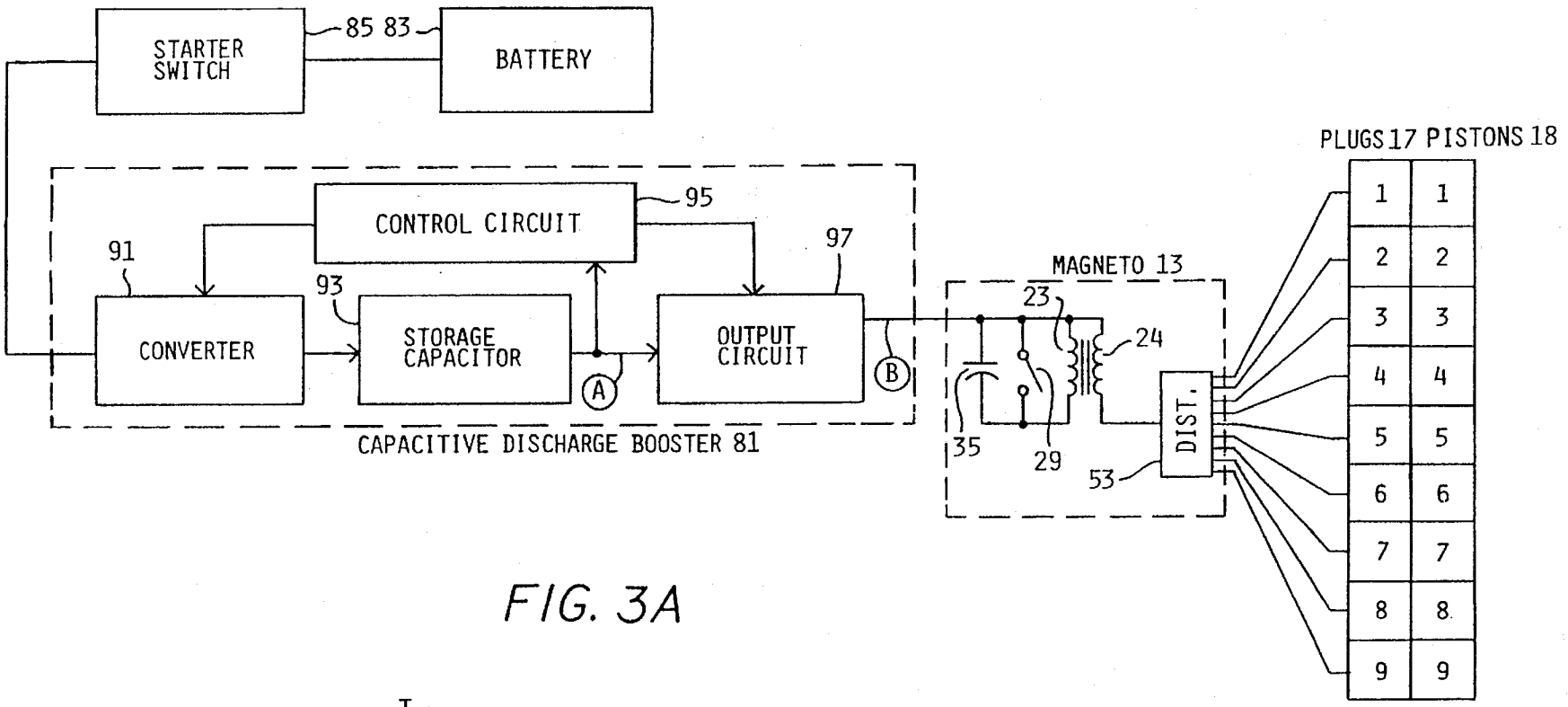
FIG. 3A is a simplified block diagram of the ignition system according to the invention, illustrating the major functional elements of the capacitive discharge booster.

In accordance with one important aspect of the invention, the capacitive discharge booster 81 includes a converter 91 as illustrated in FIG. 3A for concentrating energy from the battery 83 by pumping incremental amounts of the energy into a storage capacitor 93 at a frequency of several kilohertz. Each pumping cycle of the converter 91 adds approximately 0.3 millijoules of energy to the capacitor 93. When the capacitor 93 reaches a state of charge of approximately 150 millijoules, there is a voltage across the capacitor of approximately 350 volts. A control circuit 95 in the capacitive discharge booster 81 senses the voltage across the capacitor 93 and triggers a switch in an output circuit 97 of the booster 81, which connects the capacitor across the primary coil 23 of the magneto 11. When the breaker 29 is open, the capacitor then discharges into the primary coil 23. When the breaker 29 is closed, however, the capacitor 93 is shorted and the discharge current is limited by a choke as discussed hereinafter.

Figure 3B:
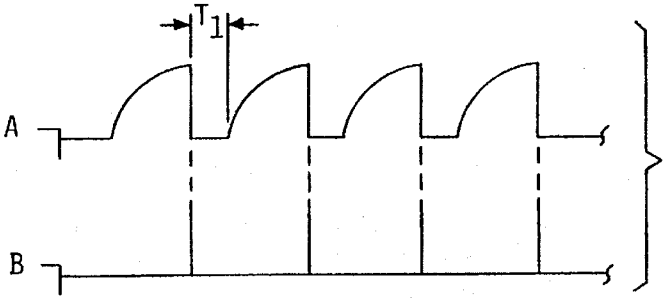
FIG. 3B is an idealized diagram of voltage waveforms A and B generated at a storage capacitor and at an output, respectively, of the capacitive discharge booster illustrated in FIG. 3A.

The waveform of a voltage across the storage capacitor illustrated in FIG. 3B shows a time period $T_1$ between the discharging of the capacitor 93 and a subsequent beginning of a charging cycle. During the time period $T_1$, the converter 91 is disabled by the control circuit 95 in order to ensure that a switch (not shown) in the output circuit 97 reliably turns off before a new charging cycle begins. Preferably, when the voltage across the storage capacitor 93 reaches a predetermined value, the control circuit 95 responds by triggering on the switch in the output circuit 97 and disabling the converter 91. The control circuit 95 maintains the converter 91 in a disabled condition for the time period $T_1$ in order to ensure that the storage capacitor is fully discharged and the switch commutates to an off condition for the next charging cycle. Preferably, the value of the time period $T_1$ is the minimum value that ensures reliable commutation under all expected ambient conditions, which results in the highest possible discharge rate for the booster 81.

Because of the high pumping frequency and the small amount of energy delivered to the capacitor 93 in each pumping cycle, the converter 91 is both able to concentrate energy in the capacitor 93 that is sufficient to provide a high energy pulse to the spark plugs 17 during cranking of the engine 67 and maintain a size and weight of the converter, and thus the overall capacitive discharge booster 81 that is amenable to aircraft and portable applications. Specifically, the primary component determining the overall size and weight of the converter 91 and of the booster 81 is a transformer in a "flyback" configuration for pumping energy from the battery and concentrating it in the capacitor 93. Each pump cycle in the "flyback" configuration consists of one cycle of energy buildup in a primary winding of the transformer followed by release of the energy, which collapses the magnetic field in the primary winding, thereby coupling the energy stored in the primary winding to a secondary winding. From the secondary winding, the energy flows to the capacitor 93. Because each pumping cycle transfers only a small amount of energy, the windings of the transformer and its magnetic core can be relatively small and light weight—e.g., a volume of nine (9) cubic centimeters and a mass of 14 grams.

Although each pumping cycle of the converter 91 delivers only approximately 0.3 millijoules of energy to the capacitor 93, the relatively high frequency of the pumping cycles results in the converter delivering to the capacitor the full 115 millijoules of energy in less than 9.5 milliseconds. Thus, the capacitive discharge booster 81 provides high energy pulses at a frequency of approximately 40 kilohertz, which is sufficient to provide each spark plug 17 with approximately five (5) pulses for each dwell period, assuming a cranking RPM of approximately 200.

Assuming approximately 50 percent coupling efficiency between the primary and secondary coils 23 and 24, respectively, each pulse of energy from the capacitive discharge booster 81 delivers approximately 60 millijoules of energy to one of the plugs 17. If five of these pulses are delivered each time the points are opened, each combustion cycle for a given piston receives approximately 300 millijoules of energy, which is at least ten times more energy than provided by a conventional start booster such as an induction vibrator or impulse coupling. Moreover, because the capacitive discharge booster 81 delivers each pulse of concentrated energy at approximately 350 volts, the pulses of approximately 60 millijoules applied to each spark plug 17 is characterized by a voltage amplitude of approximately 23K volts compared to a voltage of 8K volts delivered by pulses generated from a conventional induction vibrator or 16K volts generated with an impulse coupling. The higher voltage more reliably ionizes the gap between the electrodes of the plugs to create a low impedance plasma, which is a prerequisite for generating a spark. This contrasts with a conventional induction vibrator which has a larger and heavier magnetic structure—e.g., a volume of 25 to 50 cubic centimeters and a mass of 180 to 360 grams, and the induction vibrator disclosed in the French patent—e.g., a volume of 125 cubic centimeters and a mass of 350 grams.

As illustrated in FIGS. 4(C), (D) and (E), when the opposing contact points 27 and 31 of the breaker 29 are open, any current in the primary coil is interrupted (assuming the switch 19 is in the "on" position), thus producing a high voltage in the primary coil 29, which induces a high voltage in the secondary coil 24 of the magneto 13. The capacitive discharge booster 81 provides output pulses at a frequency of approximately 60 per second. At this frequency, approximately five pulses are delivered to the primary coil 23 of the magneto 13 each time the contact points 27 and 31 of the main breaker 29 are opened at cranking RPMs. The voltage waveforms in FIGS. 4(D) and (E) are idealized presentations of the sequence of voltage pulse packets generated at the primary and secondary coils 23 and 24, respectively, for a sequence of three pistons 18 (FIG. 3A) reaching their top dead center (TDC) position demarked in time by FIG. 4(A).

Figure 4:
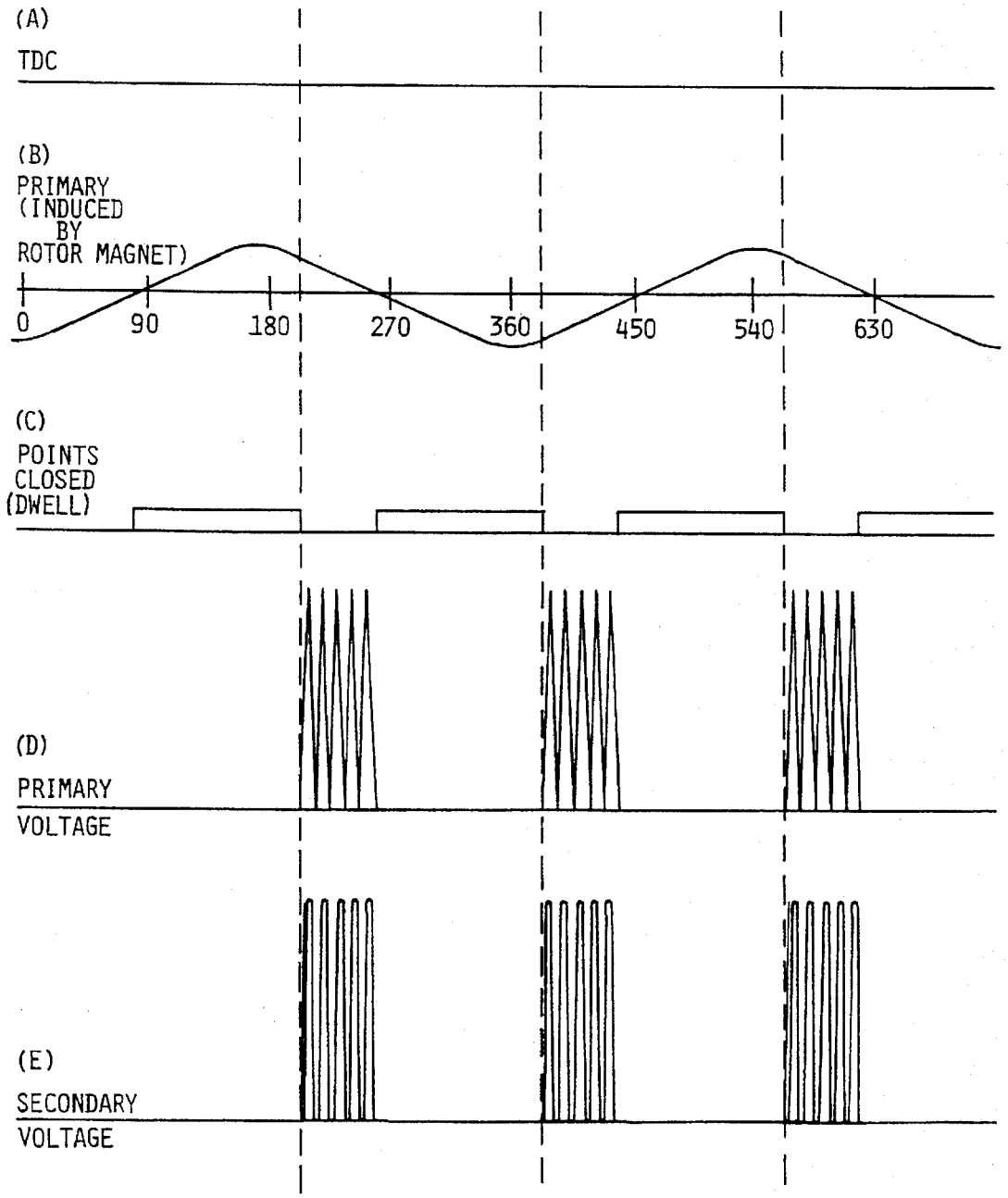
FIG. 4 is a timing diagram including exemplary and idealized waveforms A through E, which illustrate various waveforms and timing parameters during the starting of the ignition system incorporating the invention.

The waveform of FIG. 4(E) illustrates the voltage induced in the primary winding 23 for two full rotations of the rotor magnet 63. In a conventional manner, the timing relationship between the top dead center (TDC) positions of the pistons and the maximum and minimum values of the cyclical voltage induced by the rotor magnet 63 at the primary coil 23 is such that a maximum or minimum induced voltage occurs in association with a TDC of one of the pistons as illustrated by the timing relationship between FIGS. 4(A) and (B). In this regard, each of the voltage pulses from the capacitive discharge booster 81 is of a positive polarity and induces a positive voltage pulse at the primary and secondary coils 23 and 24, respectively, whereas the rotor magnet 63 alternately induces positive and negative pulses to the primary coil 23 as suggested by FIG. 4. The voltage induced in the primary coil 23 by the magnet rotor 63, however, is of much smaller magnitude than the voltage induced in the coil by the capacitive discharge booster 81. Typically, the voltage induced by the pulses from the capacitive discharge booster 81 are of a voltage on the order of 350 volts, which makes negligible the effect of any negative voltage induced by the rotor magnet 63, which is on the order of four (4) maximum volts. This contrasts with a conventional induction vibrator, that delivers pulses on the order of six (6) to twelve (12) volts, which is greatly affected by rotor-magnet induced voltages.

The relative amplitudes of the two voltages induced in the primary coil 23 sum as illustrated by the voltage packets in the waveform of FIG. 4(D). As the several packets in the waveform of FIG. 4(D) illustrate, their amplitudes are substantially unaffected by the polarity of the voltage induced at the coil by the rotor magnet 63. Similarly, the voltage induced at the secondary winding as illustrated in the waveform of FIG. 4(E) is also substantially unaffected by the alternating polarity of the voltage induced by the magnet rotor 63.

Figure 5:
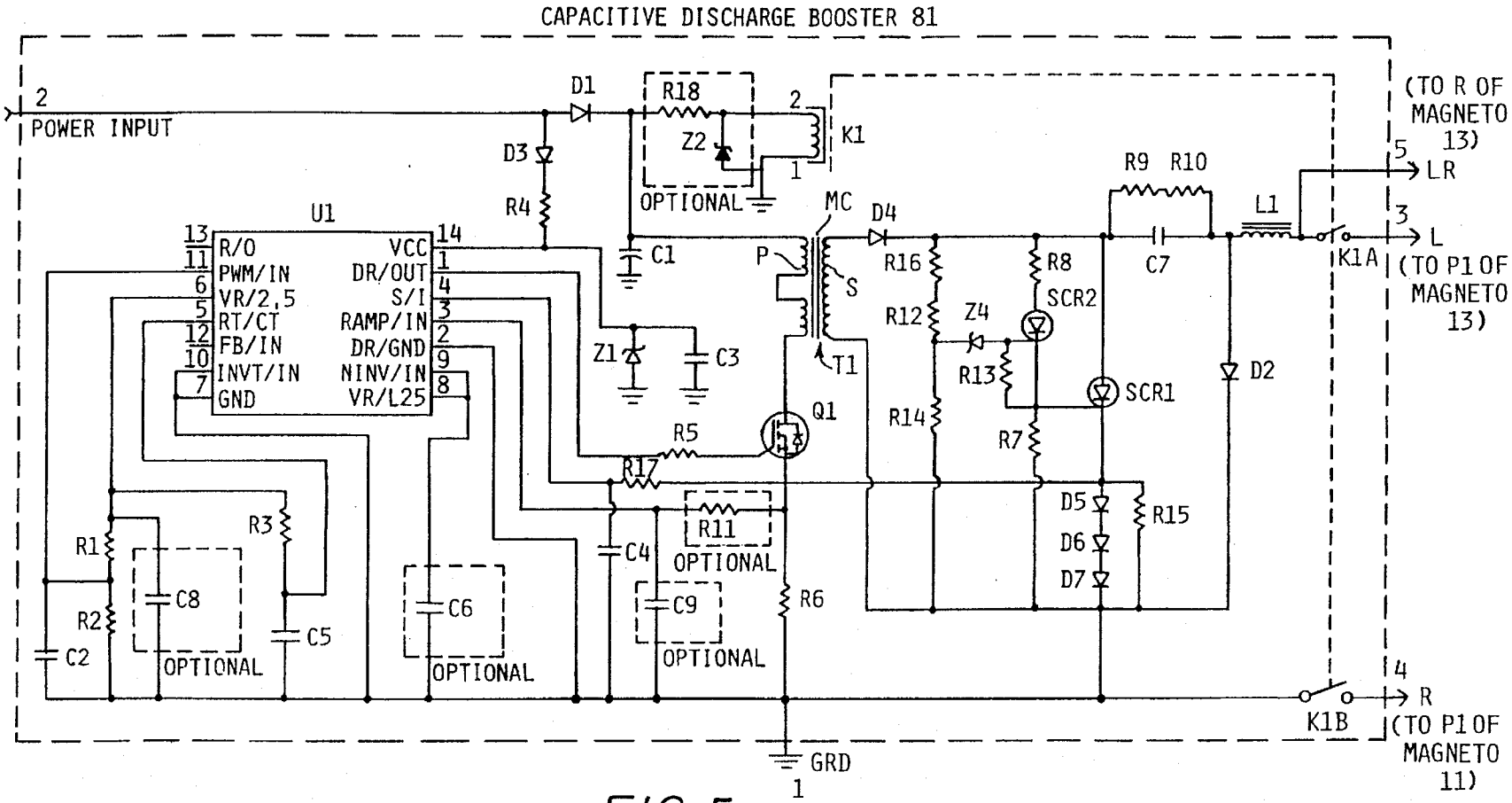
FIG. 5 is a detailed circuit diagram of the capacitive discharge booster.

Referring to the detailed schematic diagram of FIG. 5, when the capacitive discharge booster 81 receives energy from the battery 83, the relay K1 is energized and the switches K1A and K1B close in order to connect the output of the booster to the magneto 11. When the engine 67 starts, the starter switch 85 is released and the battery 83 is decoupled from the booster 81, which removes power to the circuitry of the booster and de-energizes the relay K1.

The converter 91 of the capacitor discharge booster 81 comprises a current-mode switching regulator U1, which may be an integrated circuit model No. MC3312P manufactured by Motorola, Inc.. The converter circuit 91 also includes a transformer T1 in a "flyback" configuration with the current mode switching regulator U1. A three-terminal device or transistor Q1 connected in series with a primary winding P of the transformer T1 is driven by the current-mode switching regulator U1. The regulator U1 provides pulses to a gate terminal of the transistor Q1 to turn it on and off, thereby developing a dynamic current through the primary winding P in a conventional manner that creates a flux linkage for coupling energy from the primary winding to a secondary winding S with the aid of a magnetic core MC for concentrating the flux.

When the transistor Q1 is turned on by the current-mode switching regulator U1, a current quickly develops through the primary winding P and begins to ramp upwardly. A current sensor in series with the primary winding P and the transistor Q1 in the form of a resistor R6 senses the magnitude of the current through the primary winding and converts it to a proportional voltage, which is fed back to the regulator U1. When the transistor Q1 is turned off by the current mode switching regulator U1, the energy stored in the primary winding P is transferred to the secondary winding S, which in turn supplies the energy to a capacitor C7 through diodes D2 and D4. The capacitor C7 is the storage capacitor 93 of FIG. 3A. When the current mode switching regulator U1 again turns on the transistor Q1, the "flyback" or pump cycle is ended and a new pump cycle is initiated. The drive signal controlling the on/off cycling of the transistor Q1 is synchronized to a free-running oscillator in the current-mode switching regulator U1. Resistor R3 and capacitor C5 determine the operating frequency of the internal timer.

When power is applied to the capacitive discharge booster 81 at terminal 2, the current-mode switching regulator U1 begins to cycle the transistor Q1 on and off in response to the current-sensing resistor R6, which causes energy to be pumped into the storage capacitor C7. The network of diodes D3, resistor R4, capacitor C3 and zener diode Z1 provide a regulated power supply input to the regulator U1. The current-mode switching regulator U1 pulse-width modulates the on/off cycling of the transistor Q1 in response to the voltage across resistor R6 reaching a value of the voltage at a node in the voltage divider network R1 and R2.

Energy is stored in the transformer T1 in accordance with the relationship $E=\frac{1}{2}LI^2$, where L is the inductance (Henrys) of the primary winding P of the transformer T1 and I is the current (Amperes) through the primary winding P supplied from the battery 83 by way of the capacitor C1. The capacitor C1 supplies the peak current demand of the transformer T1 and receives an average current from the battery 83 through diode D1. The average current supplied from the battery 83 is on the order of three (3) amperes, whereas the peak current through the transformer T1 is in excess of 10 amperes.

As the regulator U1 cycles the transistor Q1 on and off, the transformer T1 pumps incremental amounts of energy into the capacitor C7. Specifically, when the current to the primary winding of the transformer T1 reaches a predetermined level as sensed by the current sensor R6, the current mode switching regulator U1 turns off the transistor Q1, causing the magnetic field in the primary winding of the transformer T1 to collapse and transfer energy from the primary winding to the capacitor C7 as described above in connection with the "flyback" cycle.

As the total energy stored in the capacitor C7 increases, the voltage across the capacitor also increases. The voltage across the capacitor C7 appears across a resistive network comprising resistors R16, R12 and R14, which is part of the control circuit 95 of FIG. 3A. When the voltage at the node between resistors R12 and R14 reaches a predetermined value, a zener diode Z4 conducts and delivers a trigger pulse to a gate of a solid state switch SCR2, which turns on the switch. In turn, the cathode of switch SCR2 drives a trigger input of switch SCR1. Thus, when switch SCR2 turns on, it triggers switch SCR1 into an "on" state. When switch SCR1 turns on, the capacitor C7, which has been charged to about 350 volts, is switched to the output terminals 3, 4 and 5. SCR2 is smaller than SCR1 and provides a precision trigger voltage for the larger SCR2. By way of example, SCR1 is a model 2N 6405 and SCR2 is a MCR100-6, both manufactured by Motorola Inc.

The output circuit 97 of FIG. 3A includes the solid state switches SCR1 and SCR2, freewheeling diode D2 and inductor L1. Inductor L1 limits the discharge current from the capacitor C7 when the breaker of the magneto 11 is closed and there is a direct short across the terminals 3/5 and 4. In the preferred embodiment, the inductor L1 is similar in construction to the inductor in the output circuit described in U.S. Pat. No. 5,065,073, which is hereby incorporated by reference. An example of an appropriate inductor is Unison production No. 9047881, manufactured by Unison Industries Limited Partnership, Jacksonville, Fla.

When the solid state switches SCR1 and SCR2 are turned on, current flows through series connected diodes D5, D6 and D7 to produce a voltage across the series connection on the order of two (2) to four (4) volts, which is fed back to the regulator U1 by way of resistor R17 and capacitor C4. These diodes and their feedback signal are part of the control circuit 95 of FIG. 3A. When the voltage appears across the series connected diodes D5, D6 and D7, the regulator U1 transfers to a standby mode, which for the time period T1 of FIG. 3B temporarily disables the regulator U1 from pumping energy into the capacitor C7 while the capacitor is being discharged into the magneto 11. Thus, the capacitor C7 is allowed to fully discharge and the solid state switches SCR1 and SCR2 to fully turn off before recharging of the capacitor is initiated. By disabling the charging function of the regulator U1 for a time period T1 while the capacitor C7 is discharging into the primary coil 23, the solid state switches SCR1 and SCR2 are assured to fully turn off at the end of the discharge event and before the next charging cycle begins. When the currents through solid state switches SCR1 and SCR2 fall below threshold values, the switches return to an open circuit condition and block a connection between the capacitor C7 and the primary coil 23.

In keeping with the invention, the series-connected diodes D5, D6 and D7 are in a series connection with SCR1. The feedback signal from the diodes is present only for the duration of the current flow through SCR1. Thus, the time period T1 of FIG. 3B is minimized by extending only as long as SCR1 is conducting current. When the current flow in SCR1 falls below a threshold value, the switch turns off in a conventional fashion, the feedback voltage goes to zero and the regulator U1 returns to an active state. Thus, the time period T1 is set at a minimum value that assures commutation of SCR1, which maximizes the spark rate of the booster 81.

Freewheeling diode D2 prevents the voltage at the primary coil 23 of the magneto induced by the rotating magnet from affecting the triggering of the solid state switches SCR1 and SCR2. Also, the freewheeling diode D2 provides a path for current to flow after the capacitor C7 has fully discharged and the inductor L1 takes over as the energy source as described in the above-identified '073 patent.

The invention, because of its relatively small size, will aid in engine starting on virtually any reciprocating internal combustion engine that uses a mechanical set of breaker points as the switching device to time an ignition impulse from a magneto-based inductive type ignition system. In addition to aircraft engines which is the illustrated embodiment of the invention, the booster has particular application on industrial engines that may sit idle for extended periods of time in remote locations. On these applications, the ability to boost the ignition system aids engine starting where fuel sediment, material corrosion, temperature, dew point and altitude make the engine difficult to start. Industrial applications like these include pumps, cement mixers, electrical generators, agricultural equipment, tractors, lawn mowers, etc. The invention can be permanently installed on these types of applications or it can be used as a portable ignition booster device. Automotive, aviation and marine racing applications that use magneto-based ignition systems also benefit from being able to optimize engine run performance. The discussion of racing applications in the following paragraph also applies to magneto-based ignition systems.

Another series of applications for the invention include internal reciprocating engines that have battery powered inductive type ignition systems that use mechanical breaker points to time the ignition discharge event. These applications may include the industrial applications mentioned above as well as engines for automotive, aviation and marine applications. An illustrative application is race car engines, which are notoriously difficult to start particularly when they are tuned for peak on-track race performance. With the invention boosting ignition during engine starting, the race engine can be tuned for optimum on-track performance resulting in a more competitive race car that can be easily and reliably started. When the portable booster is used, an automotive engine can also be started when the stored charge in the vehicle battery is insufficient to start the engine by itself, provided the engine crankshaft can be rotated manually. In marine applications, where repair services are often remote, the invention can be used to provide boosted ignition to help start a reluctant engine so that the vessel can travel to a distant facility to effect the necessary repairs.

We claim:

1. An ignition system for providing spark energy to a spark plug of an internal combustion engine having at least one reciprocating piston, the ignition system comprising in combination: a magneto having a primary coil, a rotary magnet driven by the engine and generating energy in the primary coil having a voltage of alternating polarity and a single breaker for timing a discharge of the energy from the coil to the spark plug; a capacitor for concentrating energy from a source of energy; an output circuit for delivering the concentrated energy to the primary coil of the magneto as discrete pulses whose timing is independent of the reciprocating motion of the piston; a converter responsive to the source of energy for pumping increments of energy from the source into the capacitor at a rate of at least several thousand increments per second; and a start switch for starting the internal combustion engine that enables the converter while the engine is being started and disables the converter thereafter.

2. The ignition system of claim 1 including a sensor for sensing a discharge of the capacitor into the primary coil and in response thereto providing a signal that disables the converter for a duration of the discharge.

3. The ignition system of claim 2 wherein the sensor is in a series connection with a switch in the output circuit that controls the timing of the discrete pulses, which result from the discharge of the capacitor.

4. The ignition system of claim 2, wherein the sensor and the switch are in a series connection with respect to a current through the primary coil.

5. The ignition system of claim 2 wherein the converter is disabled by the signal from the sensor for a minimum time period required to ensure commutation of a switch in the output circuit that controls the timing of the discrete pulses, which results in a maximum frequency for the timing of the discrete pulses.

6. The ignition system of claim 1 wherein the magneto includes an impulse coupling that retards the timing of the single breaker of the magneto during cranking of the engine.

7. The ignition system of claim 1 wherein the capacitive discharge circuit includes (1) a converter circuit responsive to the source of energy for concentrating the energy in a capacitor of the capacitive discharge circuit by incrementally adding energy to the capacitor at a frequency of at least several thousand increments per second and (2) an output circuit for periodically discharging the concentrated energy stored in the capacitor into the primary winding of the magneto in order to deliver the discrete pulses of energy to the primary winding.

8. The ignition system of claim 7 including a control circuit for disabling the converter circuit during a time period in which the capacitor is being discharged.

9. The ignition system of claim 7 wherein the output circuit of the capacitive discharge circuit includes a switch for controlling the discharging of the capacitor and a trigger circuit for triggering the switch to a conductive state in response to a predetermined value of a voltage of the energy concentrated at the capacitor.

10. The ignition system of claim 1 wherein the source of energy is a battery source whose energy is delivered to the capacitive discharge circuit via the start switch so that the capacitive discharge circuit is 5 enabled only during a time when the start switch is in a position for starting the internal combustion engine.

11. A method of using a capacitive discharge circuit in a starting system for an internal combustion engine having at least one reciprocating piston, the method comprising: connecting an energy output of the capacitive discharge circuit to a primary coil of the magneto; cranking the engine and applying an energy source to the capacitive discharge circuit; concentrating energy from the energy source within the capacitive discharge circuit by metering incremental amounts of energy into a storage capacitor at a frequency of more than several thousand increments per second; delivering pulses of the concentrated energy from the capacitive discharge circuit to the primary coil at a rate and relative timing independent of a rotational frequency and phase of a crankshaft of the cranking engine; and transferring energy from a rotating magnet to the primary winding of the magneto so as to induce a first voltage at the primary winding that alternates between positive and negative values that are less than a value of a second voltage induced at the primary winding by the pulses of concentrated energy, which first and second voltages consistently sum to a value (1) sufficient to reliably initiate combustion and (2) having a same polarity across the primary winding.

12. A portable starting system for an internal combustion engine having at least one reciprocating piston comprising: a source of energy; a capacitive discharge circuit responsive to the source of energy for concentrating energy from the source and discharging the concentrated energy to an output; a converter in the capacitive discharge circuit for pumping incremental amounts of energy into a storage capacitor at a frequency of at least several thousand increments per second in order to concentrate the energy; an output cable connected to the output of the capacitive discharge circuit whose distal end includes a coupling for making an electrical connection to a primary winding of a magneto; a user operable switch for selectively applying the energy source to the capacitive discharge circuit; and a housing containing (1) the source of energy, (2) the capacitive discharge circuit and (3) a coupling for attaching a proximal end of the output cable to the output of the capacitive discharge circuit.

13. A method of using the portable starting system of claim 12 comprising the following steps: attaching the coupling at the distal end of the cable to an appropriate location of the magneto; operating the switch to connect the energy source to the capacitive discharge circuit; metering to the magneto from the capacitive discharge circuit the pulses of concentrated energy; cranking the internal combustion engine in order to initiate a starting sequence; starting the engine; operating the switch to disconnect the energy source from the capacitive discharge; and disconnecting the coupling from the appropriate location on the magneto after the engine has started.

14. An ignition system for an internal combustion engine comprising a magneto driven by the engine for delivering energy to a primary coil of the magneto, a secondary coil of the magneto for coupling energy stored in the primary coil to a spark plug for generating an ignition spark, a capacitive discharge device for concentrating energy from a battery and delivering the concentrated energy to the primary coil independent of engine position and speed, a breaker switch responsive to the position and speed of the engine for timing a discharging of energy stored in the primary coil into the plug by way of the secondary coil, an impulse coupling for retarding the timing of the breaker during cranking of the engine and a start switch for enabling the capacitive discharge device during cranking of the engine and disabling the device after the engine has started.

15. The ignition system as set forth in claim 14 wherein the magneto includes a rotating magnet that imparts energy to the primary coil characterized by a voltage alternating between positive and negative values.

16. An ignition system for an engine of an aircraft comprising: first and second magnetos, each having primary and secondary coils a rotating magnet driven by the engine for imparting energy to the primary coil, each of the magnetos providing energy to one of two spark plugs associated with each piston of the engine, and a capacitive discharge device enabled by a starter switch when the engine is cranking for delivering pulses of energy to the primary coil of at least one of the magnetos at a timing and rate independent of the speed and position of the cranking engine; and the capacitive discharge device including a converter responsive to a battery for concentrating energy from the battery into a storage capacitor by pumping the energy into the capacitor in incremental amounts at a frequency of more than several thousand increments per second.

17. The ignition system as set forth in claim 16 wherein the capacitive discharge device includes an output circuit for periodically discharging the concentrated energy stored in the capacitor in order to generate the energy pulses delivered to the primary coil of the at least one of the magnetos and the output circuit includes a freewheeling diode.

18. The ignition system as set forth in claim 16 including an impulse coupling associated with at least one of the first and second magnetos.

* * * * *